US010849814B2

(12) United States Patent
Freuler et al.

(10) Patent No.: US 10,849,814 B2
(45) Date of Patent: Dec. 1, 2020

(54) THERAPY DEVICE

(71) Applicant: U-SANA MEDICAL AG, Oberwil (CH)

(72) Inventors: Niklaus Kaspar Freuler, Basel (CH); Franz Freuler, Basel (CH); Thomas Freuler, Zürich-Höngg (CH); Daniel Fluri, Bettlach (CH); Alfred Niederberger, Grenchen (CH)

(73) Assignee: U-SANA MEDICAL AG, Zürich-Höngg (CH)

( * ) Notice: Subject to any disclaimer, the term of this patent is extended or adjusted under 35 U.S.C. 154(b) by 123 days.

(21) Appl. No.: 15/752,836

(22) PCT Filed: Aug. 18, 2016

(86) PCT No.: PCT/EP2016/069581
§ 371 (c)(1),
(2) Date: Feb. 14, 2018

(87) PCT Pub. No.: WO2017/029351
PCT Pub. Date: Feb. 23, 2017

(65) Prior Publication Data

US 2018/0243154 A1 Aug. 30, 2018

(30) Foreign Application Priority Data

Aug. 18, 2015 (EP) ..... 15181314

(51) Int. Cl.
*A61H 1/00* (2006.01)
*A61H 1/02* (2006.01)

(52) U.S. Cl.
CPC ..... *A61H 1/0266* (2013.01); *A61H 1/0285* (2013.01); *A61H 1/0288* (2013.01);
(Continued)

(58) Field of Classification Search
CPC ..... A61H 1/00; A61H 1/02; A61H 1/0266; A61H 1/0285; A61H 1/0288;
(Continued)

(56) References Cited

U.S. PATENT DOCUMENTS 4,862,875 A * 9/1989 Heaton ..... A61H 1/0266 601/26
5,094,226 A * 3/1992 Medcalf ..... A61H 1/0266 601/104

(Continued)

FOREIGN PATENT DOCUMENTS

DE 102008049854 A1 * 4/2010 ..... A61F 5/019
WO 2006/040818 A1 4/2006

(Continued)

OTHER PUBLICATIONS

English translation for WO 2015, epsacenet.com, translated on Jul. 19, 2020.*

(Continued)

*Primary Examiner* — Tu A Vo
(74) *Attorney, Agent, or Firm* — Medler Ferro Woodhouse & Mills PLLC

(57) ABSTRACT

A therapy device for treating left-side and right-side body parts comprises a single-piece base plate having a left surface and a right surface, a moving segment having a support surface for a left- or right-side body part to be treated, and a drive for pivoting the moving segment back and forth relative to the base plate. The moving segment is fastened to the base plate so as to be pivotable around an axis of rotation. The left surface of the base plate is shaped for supporting thereon a left-side body portion assigned to a left-side body part to be treated. The right surface of the base plate is shaped for supporting thereon a right-side body portion assigned to a right-side body part to be treated.

14 Claims, 4 Drawing Sheets

(52) U.S. Cl.
CPC .. *A61H 2001/027* (2013.01); *A61H 2201/018* (2013.01); *A61H 2201/0173* (2013.01); *A61H 2201/1215* (2013.01); *A61H 2201/1638* (2013.01); *A61H 2201/1642* (2013.01); *A61H 2201/1676* (2013.01); *A61H 2201/501* (2013.01); *A61H 2201/5097* (2013.01)

(58) Field of Classification Search
CPC ..... A61H 1/0274; A61H 1/0237; A61H 2001/027; A61H 2201/0173; A61H 2201/018; A61H 2201/1215; A61H 2201/1638; A61H 2201/1642; A61H 2201/1676; A61H 2201/501; A61H 2201/5097; A61H 2201/1057; A61H 2201/1635; A61H 2201/164; A61H 2201/1678; A61H 2201/50; A61H 2201/5007; A61H 2201/1671; A61H 2201/1664; A61H 2201/1481; A61H 2201/149; A61H 2201/16; A61H 2201/123; A61H 2201/1207; A61H 2201/12; A61H 2205/06; A61H 2205/065; A61H 2205/067; A61H 2205/106; A61H 2205/08; A61H 2205/12; A61H 2205/125
See application file for complete search history.

(56) References Cited

U.S. PATENT DOCUMENTS

| | | | | |
|---|---|---|---|---|
| 9,237,962 | B2 * | 1/2016 | Bonutti | A61F 5/0127 |
| 2005/0251067 | A1 * | 11/2005 | Terry | A61H 1/0214 601/5 |
| 2008/0051682 | A1 * | 2/2008 | Thomas | A61H 1/0266 601/23 |
| 2010/0234776 | A1 * | 9/2010 | Borden | A63B 23/1263 601/33 |
| 2013/0204168 | A1 * | 8/2013 | Bombard | A61H 1/0244 601/5 |
| 2014/0031728 | A1 * | 1/2014 | Guillen | A61H 1/00 601/34 |
| 2016/0175182 | A1 * | 6/2016 | Hubschmid | A61H 1/0237 601/112 |

FOREIGN PATENT DOCUMENTS

| | | | | |
|---|---|---|---|---|
| WO | 2009/122480 | A1 | 10/2009 | |
| WO | 2015/022142 | A2 | 2/2015 | |
| WO | WO-2015022142 | A2 * | 2/2015 | A61H 1/0274 |

OTHER PUBLICATIONS

International Search Report dated Oct. 4, 2016 in corresponding International Patent Application No. PCT/EP2016/069581.
Translation of Written Opinion dated Oct. 4, 2016 in corresponding International Patent Application No. PCT/JP2016/069581.

* cited by examiner

THERAPY DEVICE

TECHNICAL FIELD

The invention concerns a therapy device according to the preamble of independent claim 1. Therapy devices of this kind, comprising a single-piece base plate having a left surface and a right surface, a moving segment having a support surface for a left-side or right-side body part to be treated, and a drive for moving the moving segment back and forth relative to the base plate, can be used to treat left-side and right-side body parts.

BACKGROUND OF THE INVENTION

Nowadays, various devices with which body parts can be mobilised and trained in an automated manner are used for different body part treatments. Mobilisation of this kind can be very important in the postoperative treatment of body parts connected by joints, or in other therapeutic treatment, such as osteoarthritis treatment. In such treatments, it is important both to move the joint involved through either as great an angle as possible or an adapted angle, and to spare the body part.

In the treatment of big toes, for example, therapy devices are used in which the big toe (hallux) being treated is moved or pivoted relative to the foot. The purpose of such therapy devices is to mobilise the big toe or body part to a well-controlled extent in an automated and gentle manner. In this case, the nature and extent of the mobilisation is typically adjusted as the treatment progresses.

In this context, WO 2015/022142 A2 discloses a therapy device comprising a base that has support feet and on which a moving segment is pivotally mounted. Adjacent to the moving segment, the base is equipped with the means that make it possible to fasten a support element in two different ways. The support element is shaped such as to be capable of supporting a left foot thereon when mounted on the base in one way, and for supporting a right foot thereon when mounted on the base the other way.

A disadvantage of the known devices is that they are usually bulky and inflexible. For example, the base of the aforementioned device has to be set up so that the support element can be mounted as intended. In addition, such devices also have to be pieced together, and they can come apart again or be assembled incorrectly.

Therefore, the object of the present invention is to propose a therapy device that makes it possible to treat a body part by means of mobilisation in an effective, easy-to-handle and flexible manner.

BRIEF SUMMARY OF THE INVENTION

The object is achieved according to the invention by a therapy device as defined in independent claim 1. Advantageous embodiments of the invention can be found in the dependent claims.

The essence of the invention is as follows: A therapy device for treating left-side and right-side body parts comprises a single-piece base plate having a left surface and a right surface, a moving segment having a support surface for a left- or right-side body part to be treated, and a drive for pivoting the moving segment back and forth relative to the base plate. The moving segment is fastened to the base plate so as to be pivotable around an axis of rotation. The left surface of the base plate is shaped for supporting thereon a left-side body portion assigned to a left-side body part, and the right surface of the base plate is shaped for supporting thereon a right-side body portion assigned to a right-side body part.

In particular, the left surface and the right surface are different from one another. The therapy device can thus be adapted for the left or right-side body part, making comfortable and effective treatment possible.

In the context of the invention, the term "body part" can refer to body parts in the narrower sense or also portions thereof. Body parts of this kind may, for example, be toes, fingers, hands, arms or parts thereof, such as one or more phalanges. The term can in particular mean the body unit that is to be moved as a whole by means of the therapy device and treated thereby. In particular, the term "body part" can relate to a big toe.

The body part can be a part of an extremity or limb. In this case, extremities are here understood to be body appendages that are moved by muscles and are typically in pairs, such as arms and legs. Extremities can consist of a plurality of body portions.

In the context of the invention, the term "body portion" can in particular refer to a part of the body that includes or adjoins the body part to be treated. Body portions can belong to an extremity. For example, the body portion can be a foot if the body part is a toe. It can be a forearm if the body part is a hand. Or it can be a hand if the body part is a finger.

In relation to the base plate, the term "single-piece" can refer to a single-piece or multi-piece design. This term can also cover embodiments in which several pieces are interconnected in a fixed manner, for example by an adhesive or rivets or screws. Therefore, the single-piece base plate can in particular form a unit that is handled as a whole.

In relation to the pivot movement of the moving segment, the term "back and forth" can refer to tipping in both directions. The term also includes up and down pivot movements or the like.

Since the movement portion is rotatably mounted directly on the base plate, the therapy device can consist of a small number of simple components. This makes simple and efficient handling possible when using the therapy device. For example, the device can be carried and positioned in one piece. In addition, the main plate can be simply flipped over as a whole, due to its shape, is thus suitable for both a left-side body portion and a right-side body portion. The therapy device according to the invention thus makes effective, flexible and comfortable treatment possible.

Preferably, the moving segment is equipped with a fastening apparatus for fastening the left or right-side body part being treated to the support surface of the moving segment. By means of the fastening apparatus, the body part can be joined to the moving segment such as to follow the pivot movements of the moving segment. In this way, the body part can be mobilised and the body part can be prevented from unintentionally being withdrawn from the moving segment.

Preferably, the therapy device comprises a holding apparatus designed to hold the left-side body portion on the left surface of the base plate and to hold the right-side body portion on the right surface of the base plate. The holding apparatus can also be used to hold the body portion on the therapy device as intended. In particular, together with the aforementioned fastening apparatus, the therapy device can ensure a precisely predefined movement. This can improve the therapeutic effect.

At the same time, the holding apparatus preferably comprises a strap, the strap being equipped at each longitudinal end with a fastening structure and the base plate being equipped on two opposite sides with a fastening structure that is complementary to the fastening structure of the strap, and it being possible to releasably fasten the strap to the base plate by means of the fastening structure of the base plate and the fastening structure of the strap in such a way that it extends either transversely over the left surface of the base plate or transversely over the right surface of the base plate. By means of a strap of this kind, it is a simple matter to ensure holding on both surfaces of the base plate. In particular, to change sides, the strap can simply be detached and mounted again on the other side.

The strap is preferably adjustable in length. By means of a strap that is adjustable in length, the holding apparatus can be adjusted to the individual conditions of the body portion, ensuring effective fastening. For example, the strap can be formed in two pieces, it being possible to connect the two pieces by means of a reversible closure such as a hook and loop ("VELCRO") fastener.

Preferably, the moving segment can be releasably fastened to the base plate in a first position for left-side body parts and in a second position for right-side body parts. An arrangement of this kind makes it simple for the therapy device to be changed from left-side use to right-side use and vice versa. In particular, to change between left-side and right-side use, the moving segment can be detached from the base plate, the base plate turned, and the moving segment fastened to the base plate again. The moving segment can also be releasably fastened to the base plate in a module with other components of the therapy device. For example, the moving segment can form a unit or module with the drive, which unit or module can be fastened to the base plate when the plate is in different positions. To fasten the module to the base plate, the base plate can have a receiving fixture for this purpose, into which the module can be inserted or plugged.

Preferably, the therapy device comprises a pivot pin having an insert portion, the base plate being equipped with a first pin receptacle into which the insert portion of the pivot pin can be inserted, passing through a hole in the moving segment, such that the moving segment is fastened to the base plate in the first position, and equipped with a second pin receptacle into which the insert portion of the pivot pin can be inserted, passing through a hole in the moving segment, such that the moving segment is fastened to the base plate in the second position. This arrangement can allow the therapy device to be designed effectively for use on alternate sides.

Preferably, the drive comprises an electric motor and a rod assembly, the rod assembly being coupled to the electric motor in such a way that said assembly can be moved forwards and backwards substantially in translation by the electric motor. Arranging the drive in this way makes an effective and sturdy construction possible. At the same time, the electric motor preferably comprises a rotary shaft to which the rod assembly is connected eccentrically, in a jointed manner and transversely to an axis of the shaft, such that rotation of the shaft causes the rod assembly to move forwards and backwards. In this context, the term "in a jointed manner" can refer to a connection of at least two parts that are foldable or pivotable relative to one another. Electric motors having rotary shafts can be adjusted in an extremely sturdy and precise manner. By means of the rod assembly, the rotational movement of the shaft can be converted into a translational back and forth movement.

In the process, the rod assembly is preferably connected to the moving segment eccentrically, in a jointed manner and transversely to the axis of rotation. Connecting the rod assembly to the moving segment eccentrically in this manner makes it possible to efficiently convert the translational movement of the rod assembly into the back and forth pivoting of the moving segment.

Preferably, the base plate has a hollow inner chamber in which the drive is arranged. Arranging the drive inside the base plate in this manner makes it possible to protect the drive and keep the handling of the therapy device simple. Even if the drive is arranged inside the base plate, certain portions thereof can protrude out of the inner chamber, for example for the purpose of fastening to the moving segment.

Preferably, the therapy device comprises a radio unit by means of which the drive can be controlled. In this context, the term "radio" can refer to any radio technology suitable for wireless communication. For example, the wireless communication can by via Bluetooth, WLAN or similar technologies. A different form of wireless communication can also be provided, such as communication via infrared or ultrasound. In the broadest sense, the radio unit can also be understood to be a wireless communication unit. By means of the radio unit, the therapy device can be adjusted and controlled by remote control. In particular, a tipping angle of the moving segment and a speed of the motor can be adjusted by controlling the drive. It is also possible by this means to adjust the rod assembly and thus the deflection of the moving segment.

In the process, the radio unit is preferably designed to be connected to a portable computer device, the drive being able to be controlled by means of the portable computer device via the radio unit. The portable computer device can, for example, be a laptop computer, a smartphone or a remote control specifically designed for the therapy device. The therapy device and in particular its drive can be adjusted by means of the computer device. For example, a therapy plan tailored to a patient can be drawn up and then automatically implemented. A therapy plan of this kind can, for example, include an increasing or alternating movement of the body part. In addition, the computer device can also be used to generate analyses that are useful for the therapy or for the health care professional.

Preferably, the drive is equipped with an anti-overload system. An anti-overload system of this kind can improve the safety of the therapy device. In particular, in the event of too high resistance, the body part can be prevented from being injured or the drive prevented from being damaged.

Preferably, the therapy device comprises a cover, the cover being fastened on the left or right surface of the base plate. The cover can in particular be made of a synthetic material. The synthetic material can be soft and thus ensure a certain level of wear comfort. It can also have a relatively high friction coefficient and can thus prevent slipping. Furthermore, it can be easy to wash or clean, which can be important for the hygiene of the therapy device. Preferably, the cover is replaceable. In this case, it can stick to the surface of the base plate by means of its adhesive material properties and thus be fastened without any additional means such as an adhesive or a hook and loop ("VELCRO") fastener.

BRIEF DESCRIPTION OF THE DRAWINGS

Further advantageous embodiments of the invention can be found in the following description of embodiments of the invention with the aid of the schematic drawings. In particular, the therapy device according to the invention is described in more detail below on the basis of embodiments with reference to the attached drawings, in which.

DETAILED DESCRIPTION OF EMBODIMENT(S) OF THE INVENTION

Figure 1:
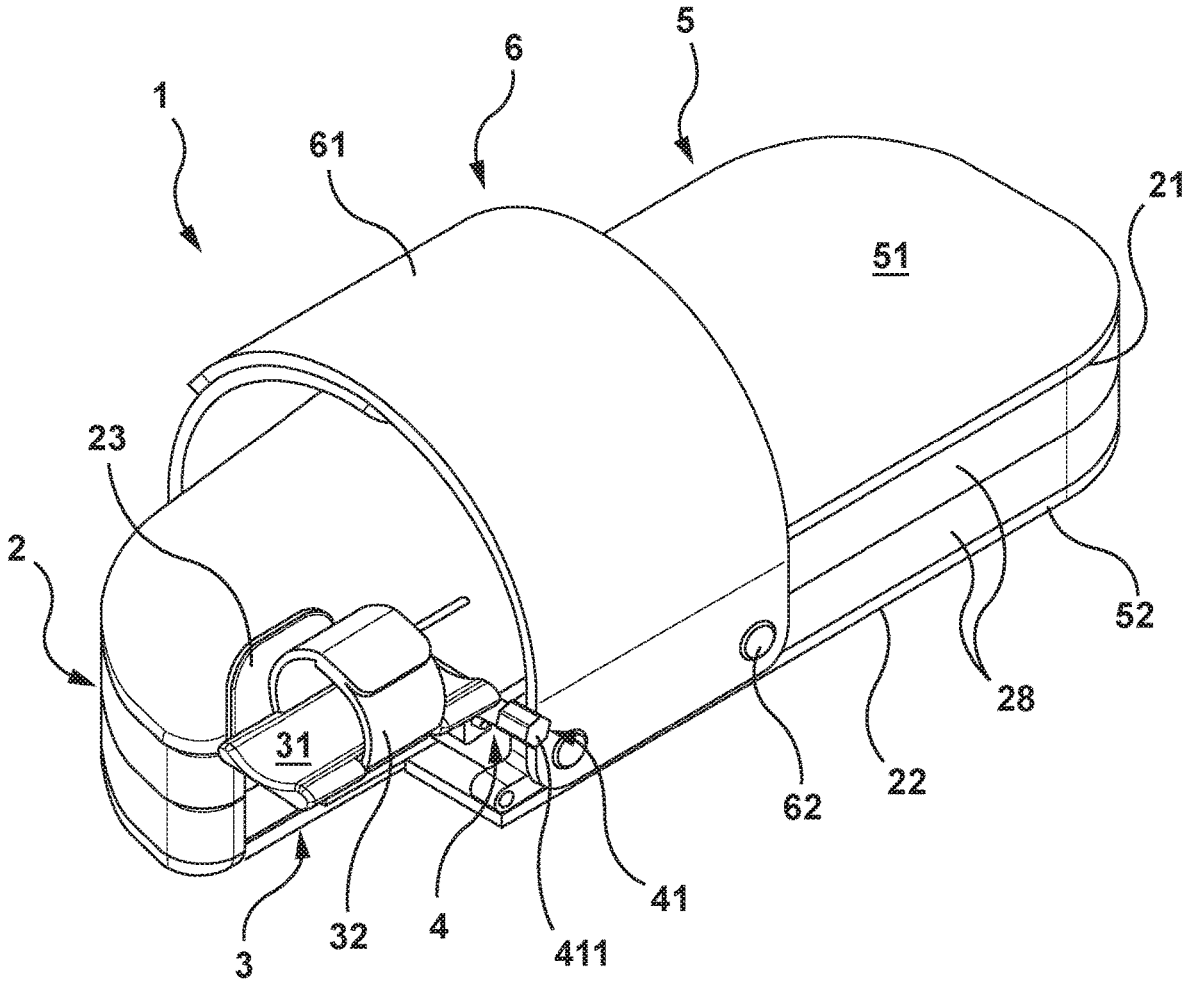
FIG. 1 is a perspective view of an embodiment of a therapy device according to the invention for treating a big toe.

Some expressions are used in the following description for practical reasons and should not be understood as limiting. The words "to the right", "to the left", "on the bottom" and "on the top" refer to directions in the drawings to which reference is made. The expressions "inwards", "outwards", "below", "above", "left", "right" or the like are used to describe the arrangement of labelled parts relative to one another, the movement of labelled parts relative to one another, and the directions towards or away from the geometric centre of the therapy device and of designated parts thereof, as shown in the figures. These relative spatial details also include different positions and orientations from those shown in the figures. For example, if a part shown in the drawings is flipped over, elements or features described as "below" are then "above". The terminology includes the words mentioned explicitly above, derivatives thereof and words with similar meanings.

To avoid repetitions in the figures and the relevant description of the various aspects and embodiments, certain features should be understood as being common to different aspects and embodiments. If one aspect is omitted from either the description or a figure, this does not necessarily mean that said aspect is missing from the embodiment in question. Instead, an omission of this kind can be used for reasons of clarity and to avoid repetitions. In this respect, the following statement applies to the entirety of the further description: If a figure contains reference numbers to aid clarity in the drawings but these are not mentioned in the directly relevant description, reference is made to the explanation thereof in previous descriptions of figures. In addition, if the text of description directly relating to a figure mentions reference numbers that are not included in the relevant figure, reference is made to the preceding and subsequent figures. The same reference numbers in two or more figures denote similar or identical elements.

FIG. 1 is a perspective view of an embodiment of a therapy device 1 according to the invention. The therapy device 1 comprises a base plate 2 having a flat right-hand surface 21 and a flat left-hand surface 22 that is different from the right-hand surface 21. In FIG. 1, the right surface 21 is on top and the left surface 22 is on the bottom. The base plate 2 consists of two flat plate parts 28 that are stacked one on top of the other and are interconnected with a fixed connection and thus form a unit, meaning that the base plate 2 is a single piece. A moving segment 3 is mounted directly on the base plate 2 by means of a pivot pin 41 of a drive 4. The pivot pin 41 has a handle portion 411 by which it can be manually held and rotated in order to be screwed in or unscrewed.

A right support 51 made of a foamed synthetic material is placed on the right surface 21 of the base plate 2. Similarly, a left support 52 made of a foamed synthetic material is placed on the left surface 22 of the base plate 2. The two supports 5 are cut to size such that they completely cover the respective left or right surfaces 21, 22. The synthetic material from which the supports are made is relatively soft and thus comfortable for a user of the therapy device 1. In addition, they are washable and thus simple to clean with soap. In addition, the synthetic material has adhesive properties that make it possible for the supports 5 to be held sufficiently firmly on the base plate 2 by being pressed thereon.

A strap 61 of a holding apparatus 6 extends transversely over the right surface 21 of the base plate 2 or the right support 51. At both of its longitudinal ends, the strap 61 is equipped with two fastening pins 62 that act as a fastening structure and are inserted into two corresponding pin receptacles formed on the longitudinal sides of the base plate 2 and acting as a fastening structure. Together, the fastening pins 62 and the pin receptacles form a reversible plug-and-socket connection. This allows the strap 61 to be reversibly fastened to the base plate 2 and removed again. In particular, the strap 61 can thus be fastened to the base plate 2 in a simple manner so as to extend over either the right support 51 or the left support 52. The strap 61 is formed in two parts and the two parts can be interconnected differently. In this way, the length of the strap 61 can be conveniently adjusted.

The moving segment 3 comprises a toe support 31 having a slightly rounded support surface adapted to a big toe. A fastening strap 32 acting as a fastening apparatus extends transversely over the support surface of the toe support 31 and is connected at its longitudinal ends to the toe support 31. Like the strap 61 of the holding apparatus 6, the fastening strap 32 is formed in two parts and is thus adjustable in length. Adjacent to the side of the moving segment 3, a lateral guide 23 extends upwards perpendicularly to the right surface 21 of the base plate 2.

Figure 2:
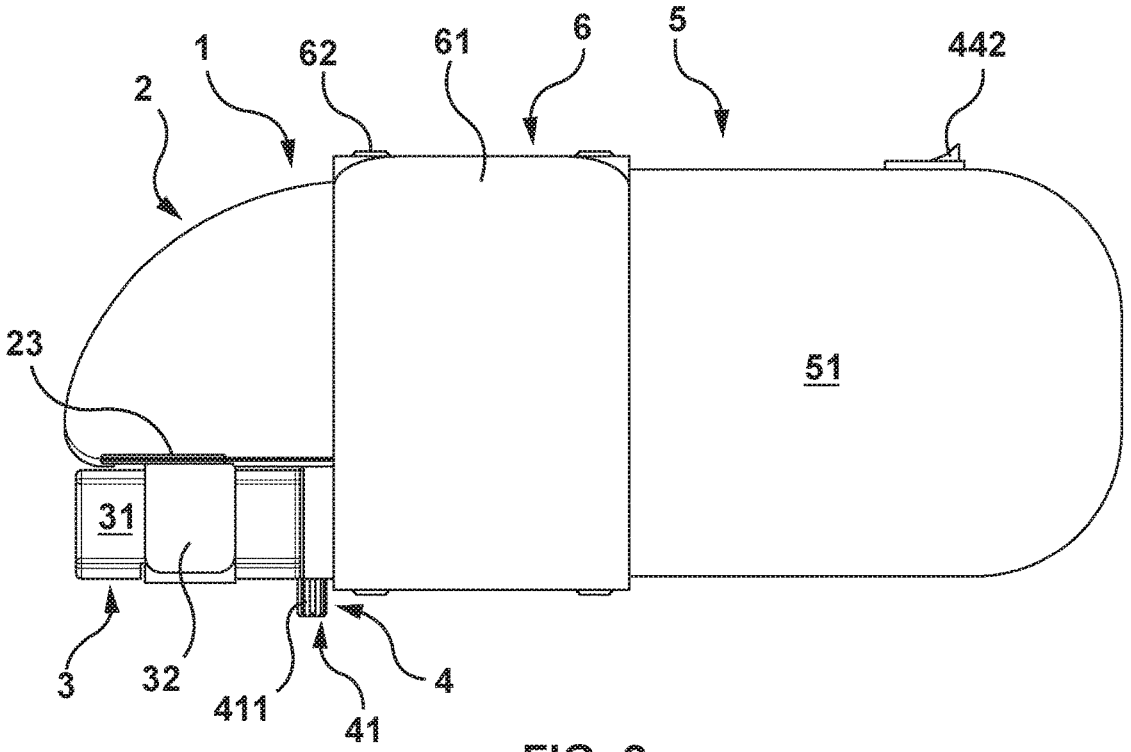
FIG. 2 is a plan view of the therapy device from FIG. 1.

As can be clearly understood in the plan view in FIG. 2, the right surface 21, which is below the right support 51 shown in FIG. 2, has a basic shape adapted to the sole of a foot. At the point at which the big toe would come to rest, there is a recess formed in the base plate 2, into which the moving segment 3 is inserted. By means of the holding apparatus 6 or the associated strap 61, the right foot of a user can be held on the right support 51 in such a way that the big toe of the user is located precisely on the support surface of the toe support 31 of the moving segment 3. By means of the fastening strap 32, the big toe of the user can be fastened on the moving segment 3.

Figure 3:
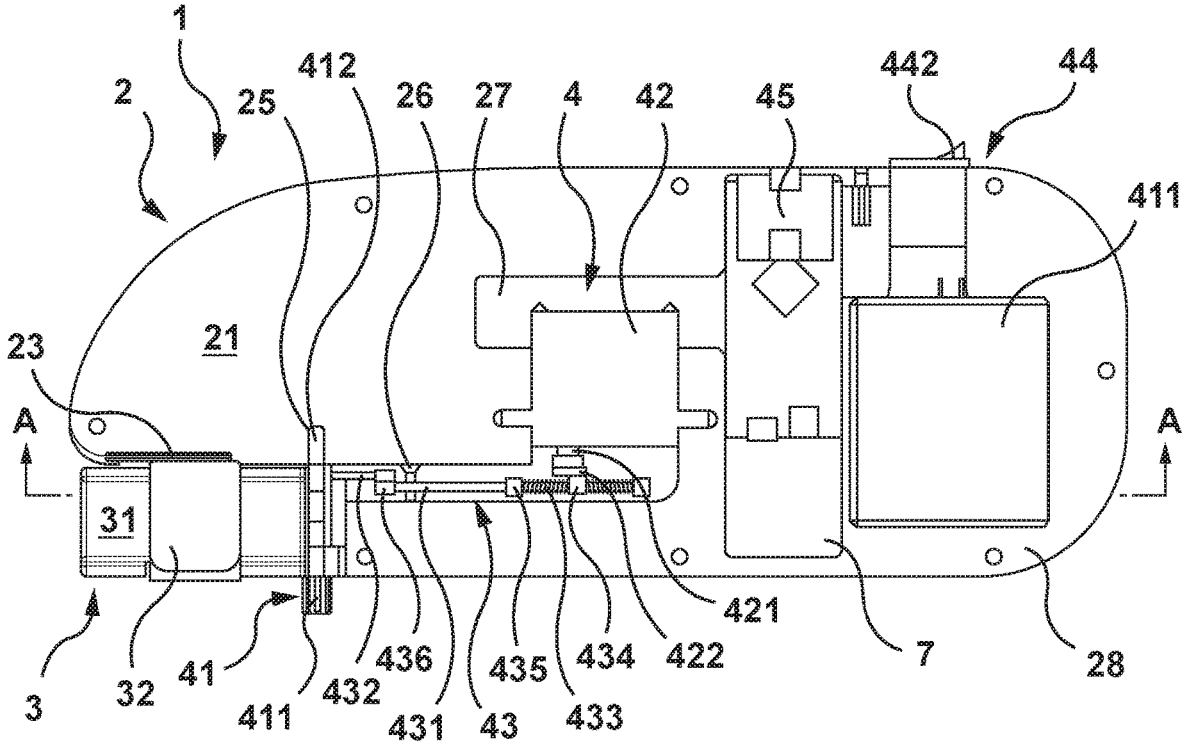
FIG. 3 is a plan view of the therapy device from FIG. 1 without upper plate part, cover or holding strap.

FIG. 3 shows the therapy device 1 from above, the upper plate part 28 of the base plate 2, the holding apparatus 6 and the supports 5 all being removed. It can be seen in this figure that the base plate 2 has a hollow inner chamber 27 in which several component parts of the therapy device 1 are arranged securely and enclosed. In particular, the drive 4 is arranged in the inner chamber 27 of the base plate 2.

The drive 4 comprises an electric motor 42 and a rod assembly 43. The electric motor 42 is permanently fixed in the base plate 2 by means of two side fins inserted into corresponding gaps in the inner chamber 27. The motor has a shaft 421 and an eccentric portion 422. The eccentric portion 422 is mounted on the shaft 421 at one longitudinal end thereof.

The rod assembly 43 has a first rod 431 and a second rod 432, which are interconnected at one of their longitudinal ends by means of a pivot joint 436. The pivot joint 436 makes it possible for the first rod 431 and the second rod 432 to be folded towards one another at said longitudinal ends and to describe a variable angle relative to one another. The first rod 431 extends through a rod assembly guide 26 of the base plate 2.

In the region of its longitudinal end facing away from the second rod, the first rod 431 is connected to the eccentric portion 422 by means of a shaft connector 434. The shaft connector 434 is clamped between two coil springs 433 wound around the first rod 431. On the outside, the two coil springs 433 are each held by a spring securing mechanism 435 that is pushed onto the first rod 431 and connected thereto by a fixed connection.

The pivot pin 41 has an insertion portion 412 opposite the handle portion 411, and the base plate 2 has a pin receptacle 25 corresponding to the insertion portion 412. The insertion portion 412 is inserted into the pin receptacle 25. In the process, the insertion portion 412 and the pin receptacle 25 can be equipped with corresponding threads such that the pivot pin 41 can be screwed into the pin receptacle 25.

A controller 45, a power supply 44 and a radio unit 7 are also arranged in the inner chamber 27 of the base plate 2. The power supply 44 includes a battery 441 and the switch 442. The power supply is coupled to all the energy-consuming components, such as, in particular, the motor 42, the controller 45 and the radio unit 7.

The controller 45 controls the motor 42 such that movement parameters of the moving segment 3 can be adjusted via said motor. In addition, the controller 45 is connected to the radio unit 7. By means of the radio unit 7, an external portable computer device, such as a smartphone, can access the controller 45 and adjust or program it such that a movement program specific to the use can be implemented. In addition, data, e.g. data regarding the progress of the therapy, can be transmitted to the portable computer device via the radio unit 7. The computer device can then analyse and/or display the transmitted data.

Figure 4:
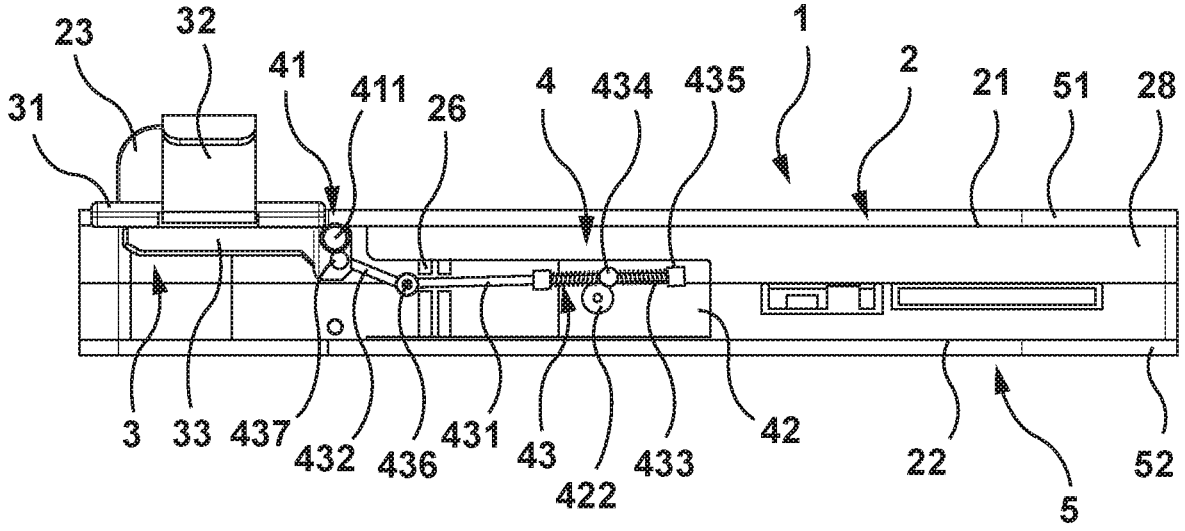
FIG. 4 is a partly sectional side view along the line A-A from FIG. 3, in which a moving segment is in a horizontal position.
Figure 5:
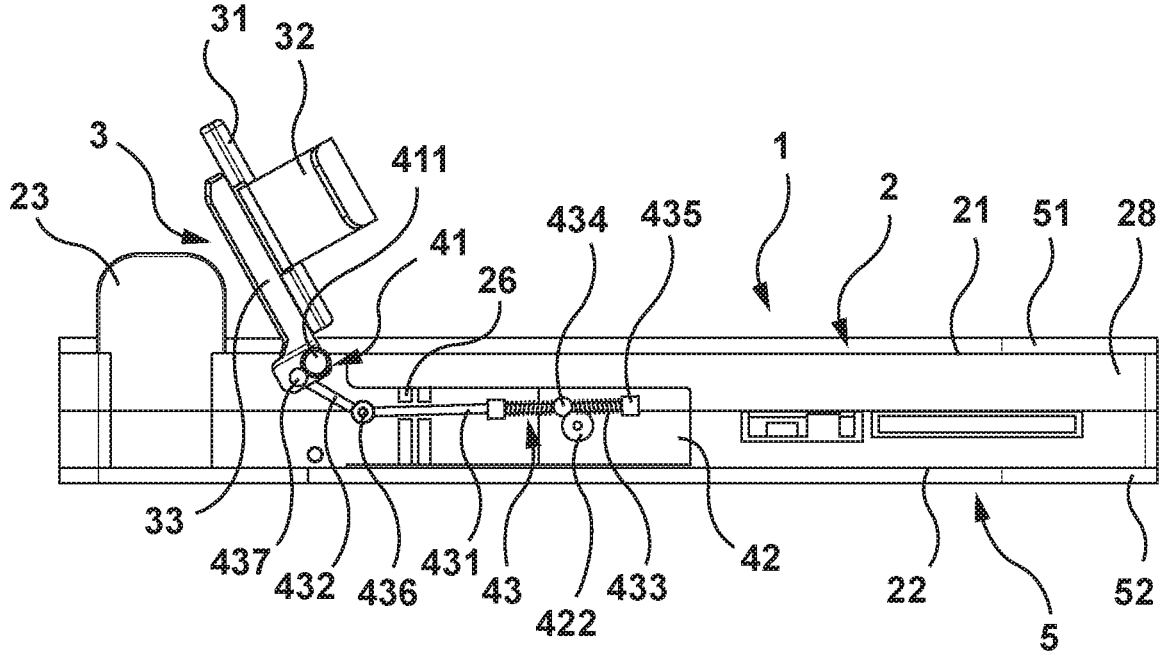
FIG. 5 is a partly sectional side view along the line A-A from FIG. 3, in which the moving segment is in a position deflected outwards.
Figure 6:
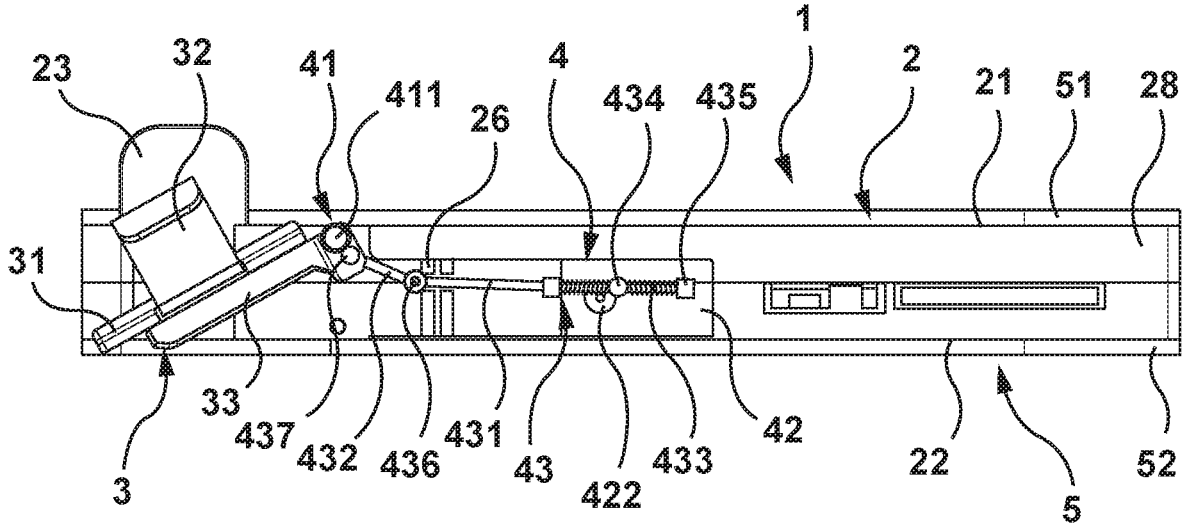
FIG. 6 is a partly sectional side view along the line A-A from FIG. 3, in which the moving segment is in a position deflected inwards.

FIGS. 4 to 6 show the therapy device 1 in operation. In FIG. 4, the drive 4 is deflected outwards such that the support surface of the support element 31 of the moving segment 3 is oriented horizontally. It can be seen that the moving segment comprises a base 33 carrying the support portion 31. The pivot pin 41 passes through a hole in the base 33 and the moving segment 3 can pivot around the pivot pin 41 relative to the base plate 2.

The second rod 432 of the rod assembly 43 is connected at a pivot joint 437, at its longitudinal end facing away from the pivot joint 436, to the base 33 of the moving segment 3. At the same time, the second rod 432 is secured to the base 33 so as to be offset from the pivot pin 41 or from the axis of rotation of the moving segment. The second rod 432 is thus connected at the Divot joint 437 to the moving segment 3 so as to be disposed eccentrically, in a jointed manner and transversely to the axis of rotation thereof.

The first rod 431 passes through the shaft connector 434, said rod being able to move axially through said connector. This axial movement is, however, absorbed and limited by the coil springs 433. The shaft connector 434 is fastened to the eccentric portion 422 in such a way as to be offset from the shaft 421 and rotatable about its axis. The first rod 431 is thus connected to the shaft 421 eccentrically, in a jointed manner and transversely to an axis of rotation thereof.

The rod assembly guide 26 comprises an upper guide lug formed in the upper plate part of the plate parts 28 and a lower guide lug formed in the lower plate part of the plate parts 28. The first rod 431 runs through a gap formed by the guide lugs. The first rod is thus supported vertically and a vertical movement of the first rod 431 can be prevented or minimised by the rod assembly guide 26.

As shown in FIG. 5, an anti-clockwise rotational movement of the shaft 421 of the motor 42 leads to the shaft connector 434 being moved eccentrically in relation to the axis of rotation of the shaft 421. As a result, an axial movement of the first rod 431 towards the moving segment 3 is produced by means of the coil springs 433. The second rod 432 is thus also moved, the second rod being moved to the left in FIG. 5 and angled upwards in relation to the first rod 431. As a result, a force acts on the base 33 of the moving segment 3 eccentrically in relation to the pivot pin 41, and the moving segment is pivoted clockwise upwards.

The lateral guide 23 can also be clearly seen in FIG. 5. It is panel-shaped and inserted into a corresponding insertion holder of the base plate 2. The base plate 2 comprises two identical, opposing insertion holders, so the lateral guide 23 can be mounted on either side of the base plate 2 as required. The guide can thus protrude from either the left surface 21 or the right surface 22, as required.

FIG. 6 shows the therapy device 1 in a position rotated further. In this case, the motor 42 rotates its shaft 421 further anti-clockwise until the shaft connector 434 is positioned on the opposite side, i.e. to the right of the shaft axis, eccentrically to the axis of rotation. As a result, an axial movement of the first rod 431 in the opposite direction to the moving segment 3 or to the right is produced by means of the coil springs 433. The second rod 432 is thus also moved, the second rod being moved to the right in FIG. 6 and angled downwards in relation to the first rod 431. As a result, a force acts on the base 33 of the moving segment 3 eccentrically in relation to the pivot pin 41, and the moving segment is pivoted anti-clockwise downwards.

As shown in FIGS. 4 to 6, the rotational movement driven by the motor 42 produces a translational or axial movement of the rod assembly 43, as a result of which an up-and-down or back-and-forth movement of the moving segment 3 is produced. At the same time, the rotational movement of the shaft 421 of the motor 42 is transmitted to the first rod 431 of the rod assembly 43 in a cushioned manner. This makes it possible for the movement of the moving segment 3 to be triggered in a relatively gentle manner adapted to the resistance. In this way, a big toe that is fastened on the support surface of the moving segment 3 and belongs to a right foot held on the right support 51 can be comfortably moved together with the segment and thus treated.

Although the invention is illustrated and described in detail by means of the figures and the relevant description, this illustration and detailed description should be understood as illustrative and an example and not limiting to the invention. To avoid making the invention seem more than it is, well-known structures and techniques may not have been shown or described in detail in some cases. It goes without saying that persons skilled in the art can make modifications and changes without departing from the scope of the following claims. In particular, the present invention covers further embodiments with any combination of features, which may differ from the combinations of features explicitly described.

The present disclosure also includes embodiments with any combination of features which have been stated or disclosed above or below in relation to different embodiments. It also includes individual features in the figures, even if these are shown therein in relation to other features and/or are not named above or below. The alternative embodiments described in the figures and description, individual alternatives and the features thereof can also be excluded from the subject matter of the invention or from the disclosed subject matter. The disclosure includes embodiments that only have the features described in the claims or in the embodiments, as well as those that have additional other features.

In addition, the expression "comprise" and derivatives thereof does not exclude other elements or steps. Likewise, the indefinite article "a" or "an" and derivatives thereof does not exclude a plurality. The functions of several features set out in the claims can be fulfilled by one unit or one step. The terms "substantially", "roughly", "approximately" and the like in connection with a property or a value also in particular define precisely that property or that value. The terms "roughly" and "approximately" in relation to a given numerical value or range can relate to a value or range that is within 20%, within 10%, within 5% or within 2% of the given value or range. None of the reference numbers in the claims should be understood as limiting the scope of the claims.

What is claimed is:

1. A therapy device for selectively treating a left-side body part and a right-side body part, comprising:

a single-piece base plate having a left surface and a right surface, the base plate being configured to be flipped over such that selectively one of the left surface or the right surface is a top side of the base plate and the other of the left surface or the right surface is a bottom side of the base plate;

a moving segment having a support surface configured for receiving the left-side body part when pivotally mounted to the base plate in a first configuration or configured for receiving the right-side body part when pivotally mounted to the base plate in a second configuration; and a drive for pivoting the moving segment back and forth relative to the base plate in each of the first and second configurations, wherein the drive is housed within the single-piece base plate, wherein the moving segment is fastened to the base plate so as to be pivotable around an axis of rotation in each of the first and second configurations, wherein the left surface is the top side of the base plate and the right surface is the bottom side of the base plate in the first configuration, and the left surface is the bottom side of the base plate and the right surface is the top side of the base plate in the second configuration, wherein the left surface of the base plate is shaped for supporting thereon a left-side body portion that includes the left-side body part to be treated on the moving segment, and wherein the right surface of the base plate is shaped for supporting thereon a right-side body portion that includes the right-side body part to be treated on the moving segment.

2. The therapy device according to claim 1, wherein the moving segment is equipped with a fastening apparatus for fastening the left-side body part or the right-side body part being treated to the support surface of the moving segment.

3. The therapy device according to claim 1, comprising a holding apparatus designed to hold the left-side body portion on the left surface of the base plate when in the first configuration and to hold the right-side body portion on the right surface of the base plate when in the second configuration.

4. The therapy device according to claim 3, wherein the holding apparatus comprises a strap, wherein the strap is equipped at each longitudinal end with a fastening structure and the base plate is equipped on two opposite sides with a fastening structure that is complementary to the fastening structure of the strap, and wherein the strap is configured to be releasably fastened to the base plate by means of the fastening structure of the base plate and the fastening structure of the strap in such a way that it extends either transversely over the left surface of the base plate when in the first configuration or transversely over the right surface of the base plate when in the second configuration.

5. The therapy device according to claim 4, wherein the strap is adjustable in length.

6. The therapy device according to claim 1, wherein the moving segment is releasably fastened to the base plate in a first position for left-side body parts when in the first configuration and is releasably fastened to the base plate in a second position for right-side body parts when in the second configuration.

7. The therapy device according to claim 6, comprising a pivot pin having an insert portion, wherein the base plate is equipped with a first pin receptacle into which the insert portion of the pivot pin is configured to be inserted, passing through a hole in the moving segment, such that the moving segment is fastened to the base plate in the first position when in the first configuration, and is equipped with a second pin receptacle into which the insert portion of the pivot pin is configured to be inserted, passing through the hole in the moving segment, such that the moving segment is fastened to the base plate in the second position when in the second configuration.

8. The therapy device according to claim 1, wherein the drive comprises an electric motor and a rod assembly, wherein the rod assembly is coupled to the electric motor in such a way that the rod assembly is configured to be moved forwards and backwards substantially in translation by the electric motor.

9. The therapy device according to claim 8, wherein the electric motor comprises a rotary shaft to which the rod assembly is connected lying eccentrically, in a jointed manner and transversely to an axis of the shaft, such that rotation of the shaft causes the rod assembly to move forwards and backwards.

10. The therapy device according to claim 8, wherein the rod assembly is connected to the moving segment eccentrically, in a jointed manner and transversely to the axis of rotation.

11. The therapy device according to claim 1, comprising a radio unit by means of which the drive is configured to be controlled.

12. The therapy device according to claim 11, wherein the radio unit is designed to be connected to a portable computer device, wherein the drive is configured to be controlled by means of the portable computer device via the radio unit.

13. The therapy device according to claim 1, wherein the drive is equipped with an overload safety system.

14. The therapy device according to claim 1, comprising a cover, wherein the cover is fastened on the left surface or the right surface of the base plate.

* * * * *